US008771094B2

(12) United States Patent
Meigs et al.

(10) Patent No.: US 8,771,094 B2
(45) Date of Patent: Jul. 8, 2014

(54) MOBILE BOWLING SCORING SYSTEM CONTROL

(75) Inventors: Brandon J. Meigs, Spring Lake, MI (US); Gary A. Brouwers, Allendale, MI (US)

(73) Assignee: Brunswick Bowling & Billiards Corporation, Lake Forest, IL (US)

( * ) Notice: Subject to any disclaimer, the term of this patent is extended or adjusted under 35 U.S.C. 154(b) by 0 days.

(21) Appl. No.: 13/413,035

(22) Filed: Mar. 6, 2012

(65) Prior Publication Data

US 2013/0237335 A1 Sep. 12, 2013

(51) Int. Cl.

| | |
|---|---|
| ***A63D 1/00*** | (2006.01) |
| *A63D 5/00* | (2006.01) |
| *A63D 5/04* | (2006.01) |

(52) U.S. Cl.

CPC ... *A63D 1/00* (2013.01); *A63D 5/00* (2013.01); *A63D 5/04* (2013.01); *A63D 2005/048* (2013.01)

USPC ..... 473/54; 473/57; 473/70

(58) Field of Classification Search

USPC ..... 473/54, 57, 70; 705/14, 14.16; 707/200; 709/226, 202; 700/91–92

See application file for complete search history.

(56) References Cited

U.S. PATENT DOCUMENTS

| | | | | |
|---|---|---|---|---|
| 4,824,109 | A * | 4/1989 | Cervantes | 473/70 |
| 4,974,161 | A * | 11/1990 | Cullen | 700/92 |
| 5,618,238 | A * | 4/1997 | Kruse et al. | 473/70 |
| 5,709,607 | A * | 1/1998 | Mowers et al. | 473/58 |
| 6,599,199 | B1 * | 7/2003 | Hapshie | 473/56 |
| 6,623,369 | B1 * | 9/2003 | Shea | 473/57 |
| 6,764,410 | B2 | 7/2004 | Apple et al. | |
| 6,912,432 | B1 * | 6/2005 | Shea | 700/91 |
| 7,025,687 | B2 | 4/2006 | Bouchard | |
| 7,037,198 | B2 | 5/2006 | Hameen-Anttila | |
| 7,435,184 | B1 | 10/2008 | Tsujita | |
| 8,066,572 | B1 | 11/2011 | Timmons et al. | |
| 8,302,015 | B2 | 10/2012 | Krishnan et al. | |
| 2002/0010032 | A1 * | 1/2002 | Stiteler | 473/54 |
| 2002/0016209 | A1 | 2/2002 | Bates | |
| 2002/0147514 | A1 | 10/2002 | Apple et al. | |
| 2003/0033324 | A1 * | 2/2003 | Golding | 707/200 |
| 2005/0101397 | A1 | 5/2005 | Bouchard | |
| 2005/0164797 | A1 * | 7/2005 | Jacover | 473/70 |
| 2005/0288115 | A1 * | 12/2005 | Popielarz et al. | 473/101 |
| 2006/0259564 | A1 | 11/2006 | Stark et al. | |
| 2008/0171607 | A1 * | 7/2008 | Minard et al. | 473/54 |
| 2009/0070222 | A1 * | 3/2009 | Kestenbaum | 705/14 |

(Continued)

OTHER PUBLICATIONS

"ClayTracker—Skeet & Sporting Clays Scorekeeper for iPhone," Expogo, Inc., http://download.cnet.com/ClayTracker-Skeet-Sporting-Clays-Scorekeeper, accessed Oct. 11, 2011.

(Continued)

*Primary Examiner* — Dmitry Suhol
*Assistant Examiner* — Jason Yen
(74) *Attorney, Agent, or Firm* — Brinks Gilson & Lione

(57) ABSTRACT

In one implementation, a mobile device is integrated with a bowling center automatic scoring system. For example, a server receives a lane control command originating with the mobile device and determines or identifies a bowling lane that is associated with the mobile device. A response message or signal, which includes data indicative of the bowling lane and the lane control command to, is sent to the automatic scoring system. The automatic scoring system executes the lane control command.

20 Claims, 12 Drawing Sheets

(56) References Cited

U.S. PATENT DOCUMENTS

| | | | | |
|---|---|---|---|---|
| 2009/0143883 | A1 | 6/2009 | Pines et al. | |
| 2009/0172076 | A1* | 7/2009 | Dunbar | 709/202 |
| 2009/0177776 | A1* | 7/2009 | Denker et al. | 709/226 |
| 2010/0046443 | A1 | 2/2010 | Jia et al. | |
| 2010/0134687 | A1 | 6/2010 | Vaioli | |
| 2011/0034261 | A1* | 2/2011 | Kawaguchi | 473/54 |
| 2012/0010930 | A1* | 1/2012 | Langdon et al. | 705/14.16 |

OTHER PUBLICATIONS

"Bowling Buddy Stats Tracker," Whole Brain Studios, http://itunes.apple.com/app/bowling-buddy-stats-tracker/id348535923?mt=8, accessed Oct. 21, 2011.

"Bowling Scoreboard", raketenpioniere, http://itunes.apple.com/app/bowling-scoreboard/id313837528?mt=8, accessed Oct. 21, 2011.

"Bowling Score," castillasoft, http://itunes.apple.com/app/bowling-score/id408226455?mt=8, accessed Oct. 21, 2011.

"Duo Installation Instructions & Reference Guide," Computer Score Computer Scoring Systems, Jan. 12, 2012.

"Center Command, Version 3, Operations Manual," Computer Score Computer Scoring Systems, Dec. 7, 2011.

"Qubica Worldwide, VDB Automatic Scoring System, Installation Manual," Oct. 2005.

"Brunswick, Vector-Plus Center Network System," accessed Nov. 15, 2011.

"Brunswick, Bowling Center Products," accessed Nov. 15, 2011.

International Search Report and Written Opinion for PCT/US2013/026636, dated Mar. 14, 2013, 10 pages.

International Search Report and Written Opinion for PCT/US2013/026637, dated Apr. 26, 2013, 15 pages.

Notice of Allowance for U.S. Appl. No. 13/413,133 dated Oct. 4, 2013, 11 pages.

* cited by examiner

MOBILE BOWLING SCORING SYSTEM CONTROL

FIELD

The present disclosure relates to mobile control of one or more systems in a bowling center.

BACKGROUND

Bowling centers may include automatic scoring systems to track and display bowling scores for one or more bowlers at a lane or a pair of lanes. The automatic bowling scoring systems may include an optical pin detector. After a ball is thrown, the optical pin detector generates a signal based on which pins remain standing on the pin deck. The signal indicates a pinfall, which is automatically added to the score for the bowler. The pinfall from each frame and the accumulated store may be displayed on a video screen.

The bowlers may operate and configure the automatic scoring system by accessing a console, which includes a keypad or a touchscreen. The bowlers may edit incorrect scores, enter bowler names, select display themes, or access other features of the automatic scoring system. The automatic scoring system may be integrated with pinsetters for resetting pins and integrated with a front desk for requesting assistance.

Access to operate and configure the automatic scoring system is given based on physical presence at the console. Any person can approach the console to control the automatic scoring system. Further, since the automatic scoring system is tied to the bowling center and not to the bowler, any preferences or customizations of a bowler are lost after each visit to the bowling center. Further, no statistics, preferences, or customizations can be shared across multiple bowling centers. The present disclosure describes an automatic scoring system that minimizes or eliminates one or more of these deficiencies.

DETAILED DESCRIPTION

Overview

In general, the following embodiments integrate a mobile device with an automatic scoring system of a bowling center. A user can interact with the automatic system via a mobile application on the mobile device. A mobile application includes both software running on the mobile device and an application accessed through a browser on the mobile device. The mobile device is configured to send a lane control command to a server over cellular communication or a network, which may be wired or wireless. The server identifies a bowling lane associated with the mobile device. If the mobile device is authorized to operate or configure the automatic scoring system, the server sends a response including data indicative of the bowling lane and the lane control command to the automatic scoring system.

The lane control command may include data related to lane control, pinsetter control, front desk communication or other functions. Regarding lane control the mobile application may be configured to operate name entry, game statistics, themes, and display configuration in addition to or in lieu of a lane control console. Regarding pinsetter control, the mobile application may be configured to reset the pins of the bowling lane. Regarding front desk communication, the mobile application may be configured to request help or assistance from a bowling center employee, order food service, purchase additional bowling games, or make bowling reservations.

Figure 1:
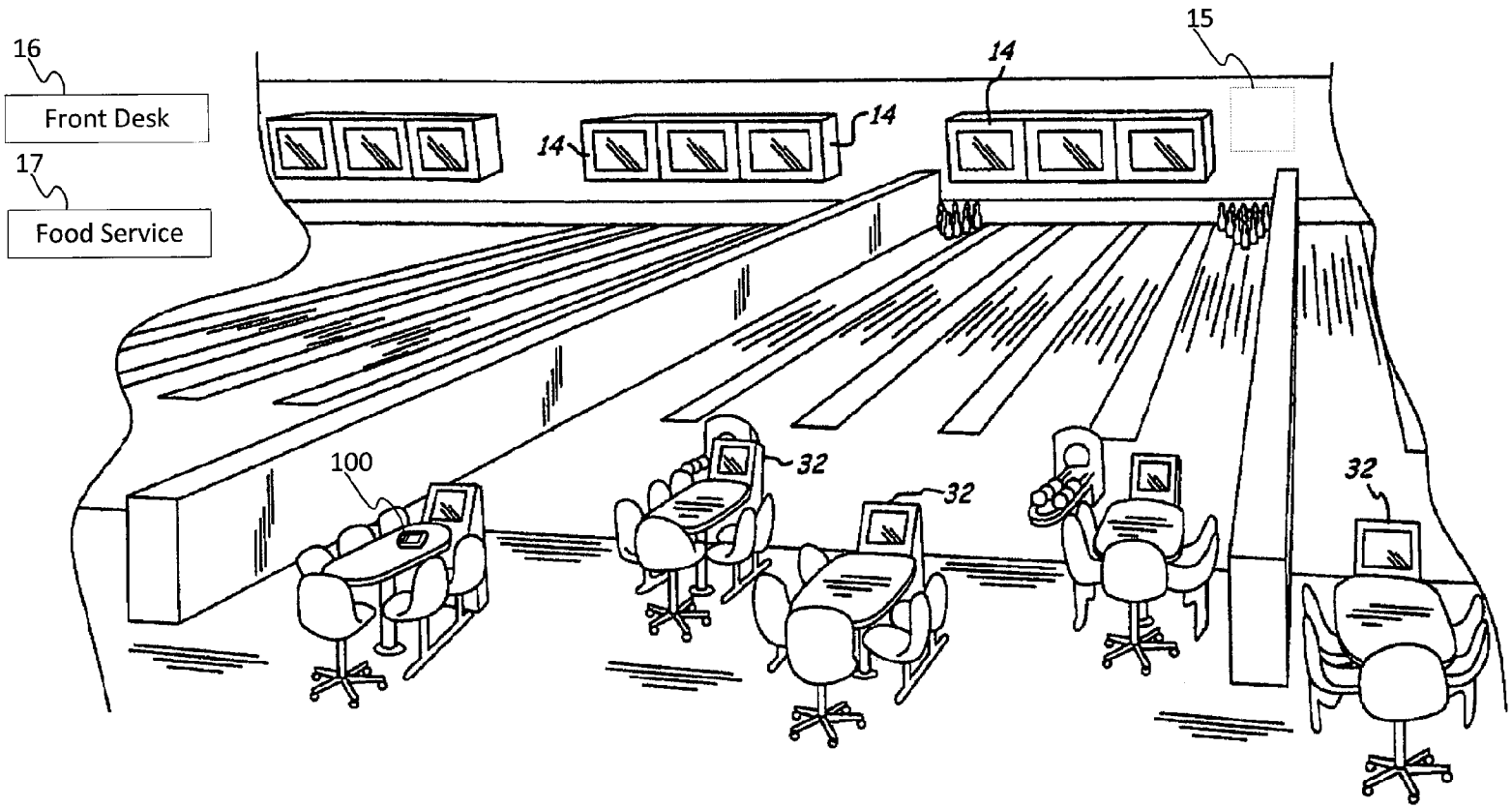
FIG. 1 illustrates a bowling center of an embodiment.

FIG. 1 illustrates a bowling center. The bowling center includes several bowling lanes supported by control systems including lane control console systems 32, overhead display systems 14, pinsetter systems 15, a front desk system 16, and a food service system 17, which may be referred to collectively or in any combination as an automatic scoring system. A mobile device 100 is configured to communicate with the automatic scoring system. The mobile device 100 may be a cellular phone (e.g., smartphone), a laptop, or another computing device. A bowler may use an input device, such as a keypad or touchscreen, included in the mobile device 100 to provide input to any of the lane control console systems 32, the overhead display systems 14, the pinsetter systems 15, the front desk system 16, and the food service system 17.

For example, the mobile device 100 communicates with the lane control console system 32 to enter names onto the displayed score sheet or to manually correct a scoring error with a few keystrokes on the keypad or the touch screen. The mobile device 100 may communicate with the overhead display systems 14, which may be combined with the lane control console system 32, to display or specify entertainment features such as graphics or graphic animations in response to the occurrence of a particular bowling event, including but not limited to gutter balls, splits, strikes and spares. The mobile device 100 may communicate with the front desk system 16 to request help or purchase additional games. The mobile device 100 may also provide non-bowling related features, such as ordering food or drinks from a snack bar through communication with the food service system 17. The mobile device 100 may be used by several bowlers at a lane or multiple mobile devices 100 may be tied to the same lane and operated by multiple bowlers.

In one alternative, the example embodiments below are combined with the embodiments described in U.S. patent application Ser. No. 13/413,133 titled Distributed Scoring System, filed Mar. 6, 2012, by Brandon J. Meigs and Gary A. Brouwers, which is hereby incorporated by reference.

Example Embodiments

Figure 2:
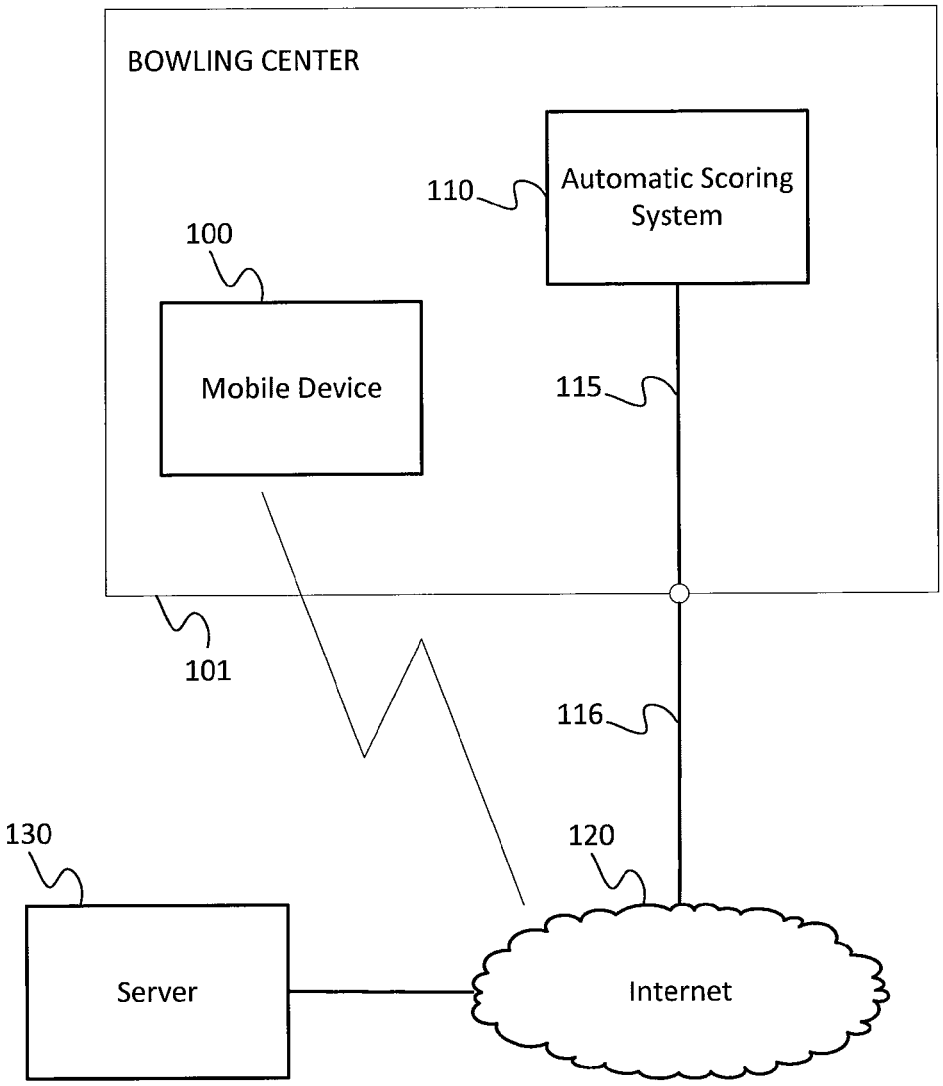
FIG. 2 illustrates the bowling center of FIG. 1 and a communication network.

FIG. 2 illustrates a bowling center 101 and a communication network, including an internal network 115 and an external network 116. The mobile device 100 is located, at least temporarily, within the bowling center 101. The automatic scoring system 110 includes one or more of the lane control console systems 32, the overhead display systems 14, the pinsetter systems 15, the front desk system 16, and the food service system 17. The internal network 115 and the external network 116 are in communication with a server 130 either directly or via the Internet 120. The server 130 may be configured to host a cloud service accessible by the bowling center 101 in order to implement the present embodiments.

Several embodiments are discussed below with varying definitions of the automatic scoring system 110. In a first embodiment, the mobile device 100 is generally complementary to the lane control console system 32, acting as a remote control to the lane control console systems 32. In the first embodiment, the lane control console system 32 is the automatic scoring system 110. In a second embodiment, the lane control console system 32 is omitted, and commands originating with the mobile device 100 are sent to the overhead display systems 14, the pinsetter systems 15, the front desk system 16, or the food service system 17, any of which or combination thereof may be considered the automatic scoring system 110. The following description applies to both the first embodiment and second embodiment except where otherwise noted.

The mobile device 100 may be a cellular telephone (smart phone), a personal digital assistant ("PDA"), a tablet computer, a laptop, a personal computer or any computing device configured for network communications. The mobile device 100 may be configured to send commands to the automatic scoring system 110 indirectly through the server 130. The mobile device 100 is configured to communicate with the server 130 through the Internet 120. The mobile device 100 may communicate with the Internet 120 through a cellular network (e.g., 2G, 3G, global system for mobile communication (GSM), long term evolution (LTE), or 4G). Alternatively, the mobile device 100 may communicate with the Internet 120 through the communication network, which may include a wireless connection (e.g., 802.11 standard, Bluetooth standard, infrared) to the internal network 115. The mobile device 100 may operate on any mobile operating system (OS), mobile software platform or a handheld OS. The mobile OS may be iOS from Apple, Windows Mobile from Microsoft, Android, Blackberry OS, WebOS, Symbian OS, or another OS. The functions of the mobile device 100 described herein may be directed by a mobile application (app) running on the mobile OS or through a web browser accessing a mobile application.

The mobile device 100 generates a lane control command. The lane control command may adjust information related to the bowling game such as the number of players, the names of players, or a player characteristic. The player characteristic may include data indicative of whether the bowler bowls with the bowler's right hand or left hand or data indicative of a handicap or average. The lane control command may configure how information is displayed such as the number of frames shown at a time. The lane control command may cause a pinsetter reset or a particular group of pins to be reset. The mobile device 100 sends the lane control command to the server 130.

The server 130 determines which bowling lanes, if any, are associated with the mobile device 100. In one example, the server 130 may determine that the mobile device 100 is associated with a particular lane because the lane control command purports to be associated with the particular lane. In other examples with additional security, the server 130 authenticates the mobile device 100 in order to associate the mobile device 100 with one or more lanes. The server 130 receives bowler authorization information from the mobile device 100. The bowler authorization information may be generated in a variety of ways. The bowler authorization information may be created from a successful login to a reservation system, or the bowler authorization information may be created from a scan by the mobile 100 device of an authorization code, for example. As another example, the bowler authorization information may be created from a manual entry of an identification code or reservation confirmation code into the mobile device 100. Each of these implementations is discussed in more detail below.

After receiving the bowler authorization information, the server 130 queries a database with the bowler authorization information. The database may be internal or external to the server 130. The database includes a look up table that associates the bowler authorization information with one or more lanes. In other words, the database authorizes the mobile device 100 to issue commands to control one or more lanes or commands associated with one or more lanes for other services. Specifically, the server 130 receives a lane identification value from the database. The lane identification value indicates a bowling lane is authorized to receive control from the mobile device 100.

Once the mobile device 100 has been authorized, the server 130 receives data originating with the mobile device 100 and including instructions for any of the control systems discussed above. The server 130 processes the data included in the lane control command and generates a response including data indicative of the bowling lane and the lane control command. The response is sent back to the automatic scoring system 110.

Figure 3:
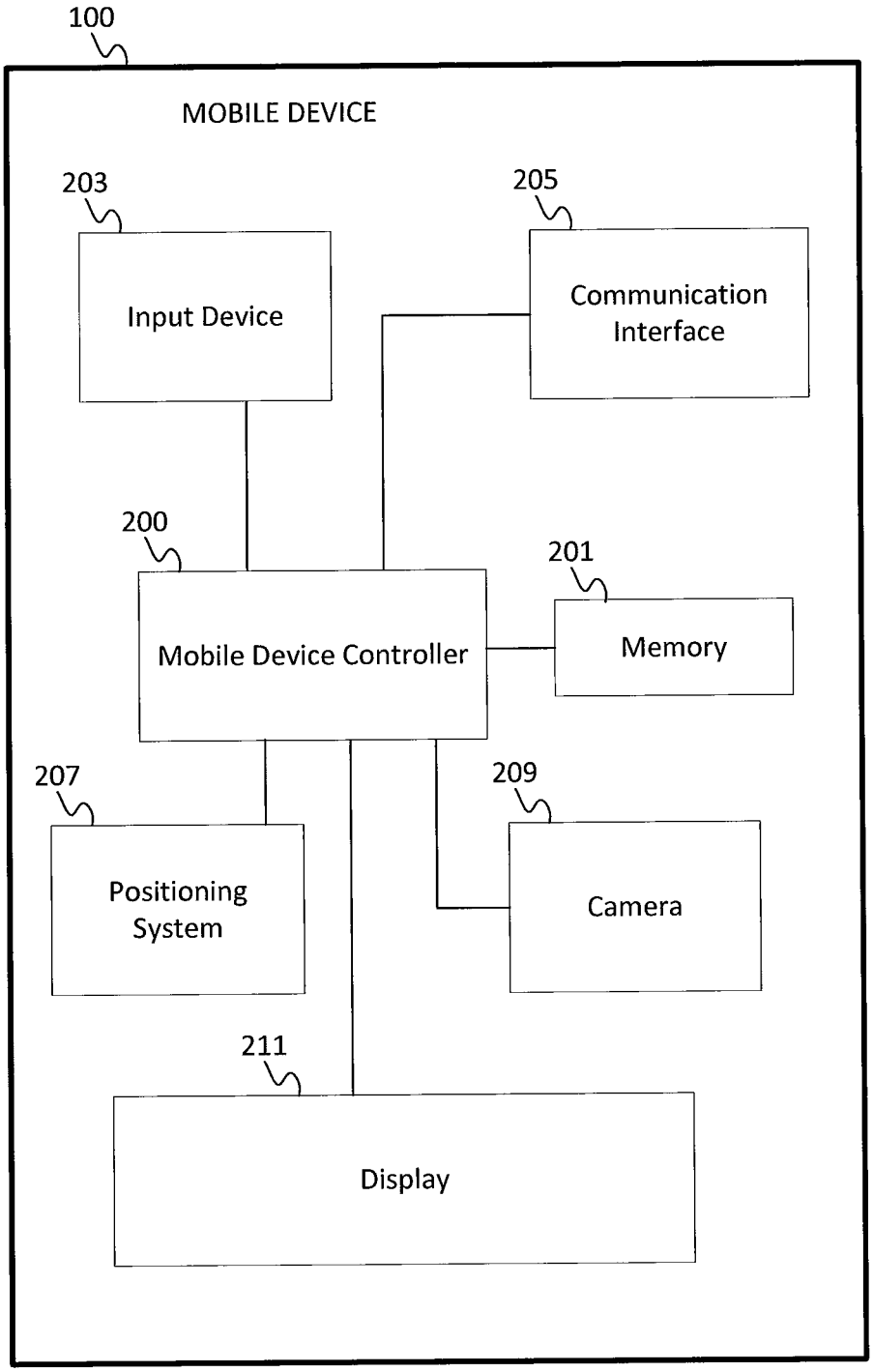
FIG. 3 illustrates a mobile device of an embodiment.
Figure 4:
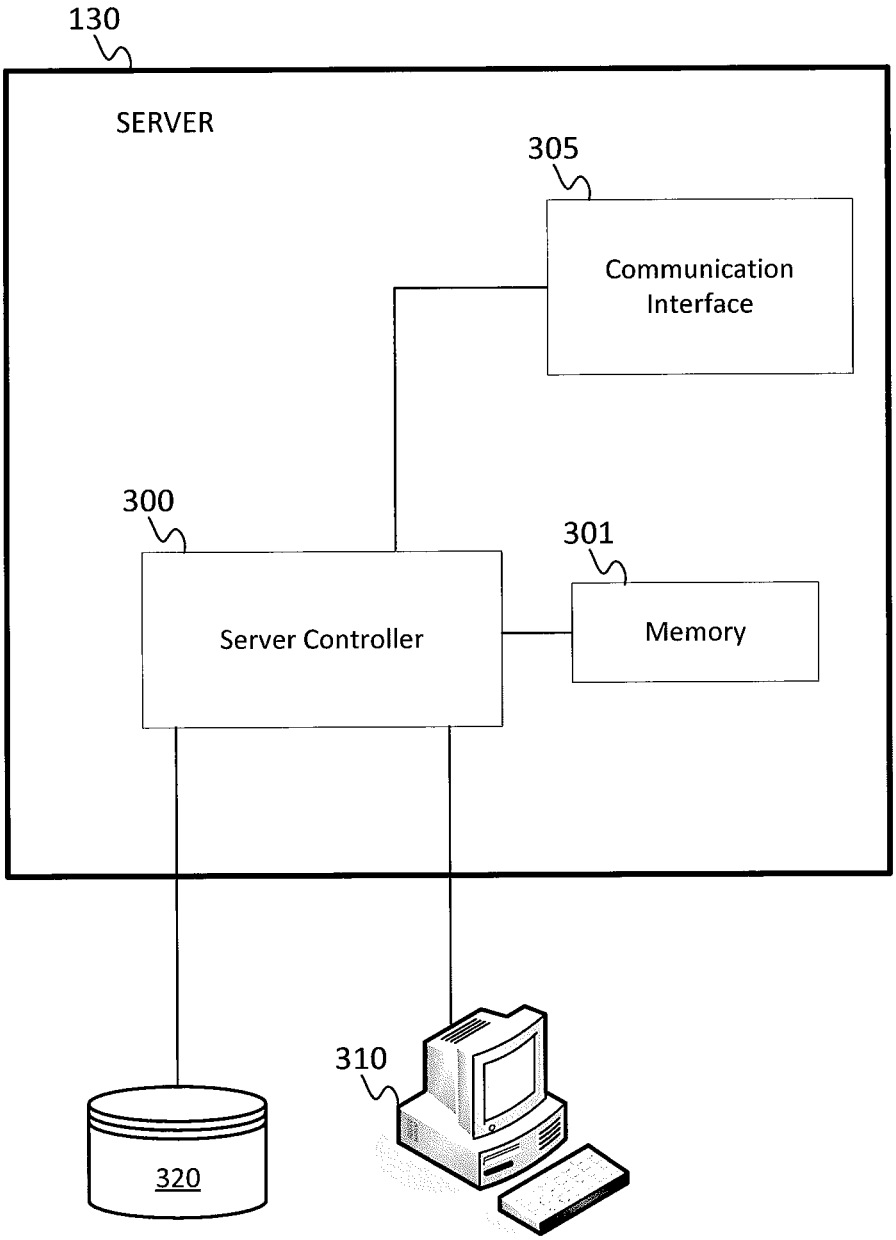
FIG. 4 illustrates the server of FIG. 2.

FIG. 3 illustrates a more detailed view of the mobile device 100 of FIGS. 1 and 2. FIG. 4 illustrates a more detailed view of the server 130 of FIG. 2. The mobile device 100 includes a mobile device controller 200, a memory 201, an input device 203, a communication interface 205, a positioning system 207, a camera 209, and a display 211. The server 130 includes a server controller 300, a memory 301, and a communication interface 305. The server 130 may be coupled to a database 320 and a workstation 310. The server 130 may be replaced with any type of network device including a personal computer or a general purpose computer.

The mobile device controller 200 is configured to generate a lane control command based on a user input received at the input device 203. The lane control command may include instructions for the operation of the mechanical systems of a bowling lane, for the scoring and display systems of the bowling lane, or for another bowling center service. The communication interface 205 is configured to send the lane control command to the server 130.

By way of the communication interface 305, the sever controller 300 receives the lane control command originating with the mobile device 100. Before forwarding the lane control command, the server controller 300 determines whether any bowling lanes are associated with the mobile device 100. If the mobile device 100 is associated with a bowling lane, the server controller 300 sends a response including data indicative of the bowling lane and the lane control command to the automatic scoring system 110.

The server controller 300 may also be configured to authenticate or authorize the mobile device 100. The memory 301 stores a lookup table of bowler authorization values associated with lane identification values. The lane identification values can include, for example, data indicative of a lane number, a bowling center, and a duration. The duration may be measured in frames, in games, or in time, and the bowler authorization value may expire when the duration elapses.

The lookup table may be populated based on a reservation system or may be populated with predetermined values. In implementations in which the lookup table is populated with predetermined values, each lane in the bowling center 101 is associated with a key, which is a bowler authorization value. The key for each lane in the bowling center 101 is static. The reservation system releases the key to the mobile 100 device either directly or indirectly when the mobile device 100 should have access to the corresponding lane of the bowling center 101.

In implementations in which the lookup table is populated based on the reservation system, each entry in the lookup table may be generated in one of several ways. A user may establish an account on the reservation system using the mobile device 100 via a website or another application running on the mobile device 100. The reservation system 100 may be operated by the server 130 or hosted elsewhere on the Internet 120. The user is assigned a login identification and password to access the account on the reservation system and make a reservation. Alternatively, the reservation could be made by any Internet enabled device. The reservation system generates a bowler authorization value associated with the reservation and sends the bowler authorization value to the mobile device 100. The bowler authorization value may be referred to as a session identifier. The reservation system assigns one or more lane identification values and sends the bowler authorization value and the lane identification values to the database 320.

In another implementation, the reservation system is maintained by the front desk control system 16, which may include a point of sale system. The user requests a reservation at the front desk. The user could alternatively provide a name, email, or phone number to access a previously recorded reservation in the reservation system. The front desk control system 16 instructs a printer to print a receipt including an authorization code. The authorization code may be an alphanumeric value. The authorization code could alternatively be communicated audibly or via a display. The front desk control system 16 sends the authorization code as a bowler authorization value associated with at least one lane identification value to the database 320. The user enters the authorization code into the mobile device 100, which sends the authorization code to the server 130 to authenticate the mobile device 100.

Figure 5A:
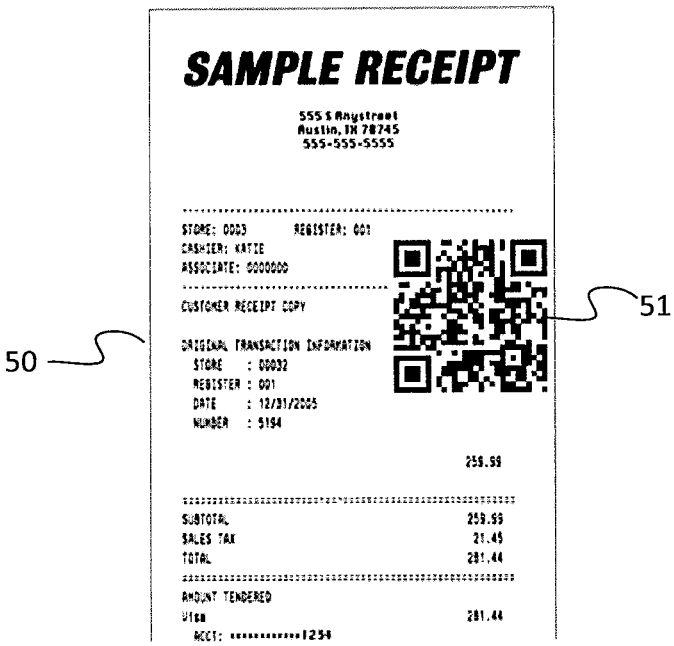
FIGS. 5A and 5B illustrate an authentication code.

The authentication code may be temporary and generated for each specific reservation. The authentication code may be the concatenation of a bowling center identification value and a lane number. In addition, the authentication code may include a date, a time, or a number of games. The authentication code may be printed or displayed as an optical machine readable representation of data. Examples of optical machine readable representations of data include a bar code or a quick response (QR) code, which is a two-dimensional barcode. FIG. 5A illustrates an example receipt 50 generated at the front desk including a QR code 51, which could be any optical machine readable representation of data. The receipt 50 and/or QR code 51 may be included in an email received at the mobile device 100 from the reservation system or printed and scanned by the camera 209 of the mobile device 100.

Figure 5B:
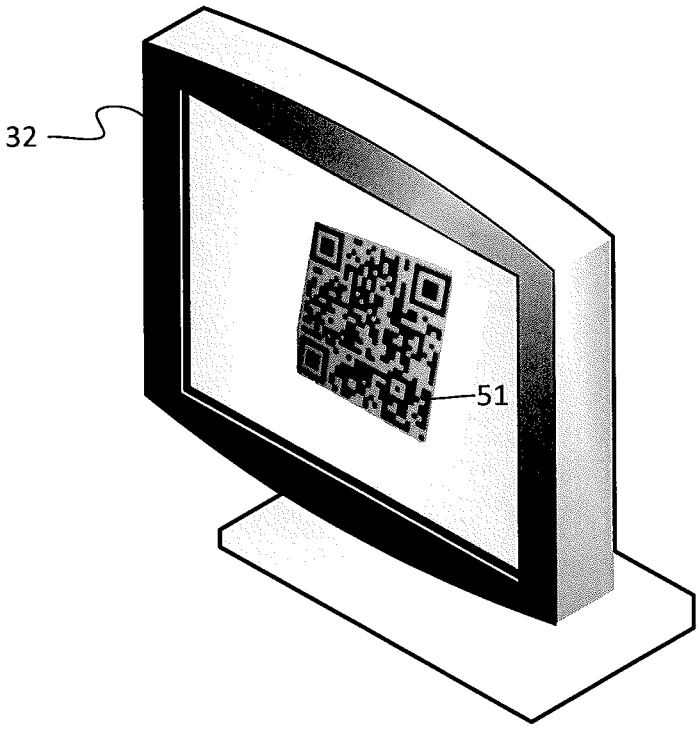

FIG. 5B illustrates an implementation in which the QR code 51 or any optical machine representation of data may be displayed by the lane control console system 32. In this implementation the reservation system may be omitted. Instead, the lane control console system 32 generates the bowler authorization value. The mobile device 100 is authorized because the mobile device 100 is physically located close enough to the console to scan an image of the QR code 51. Alternatively, the bowler authorization value could be a code read from the console and typed into the mobile device 100.

In another example, the mobile device 100 may be authorized because the mobile device 100 is located within the bowling center 101. For example, communication received at the server 130 from the mobile device 100 that has been routed through the internal network 115 may be considered authorization information. Further, the server 130 may deem the mobile device 100 authorized if the mobile device 100 has been assigned an internet protocol (IP) address associated with the internal network 115.

Another example of when the mobile device 100 may be authorized because the mobile device 100 is located within the bowling center 101 occurs based on the detected position of the mobile device 100. The positioning system 207 may determine a geographical location of the mobile device 100. The positioning system 207 may interact with one or more of a global navigation satellite system based on a satellite signal (such as Global Positioning System (GPS), the Russian GLONASS or European Galileo). In addition or the alternative, the positioning system 207 may include a triangulation system that utilizes one or more terrestrial communication signals (e.g., cellular signals) or a inertial position system based on relative position sensors such as gyroscopes, accelerometers, and altimeters, and/or a dead reckoning system based on a previously known position.

The server controller 300 may be configured to match the geographical location of the mobile device 100 with a geographical location of the bowling center 101. In this example, the data indicative of the geographical location of the mobile device 100 is considered authorization information. In this example, the lane identification value may include all available lanes or the lane identification value may be selected by the mobile device 100.

As discussed above, there are several possible paths for the authorization information to be entered into the mobile device 100 and sent to the server 130. First, the mobile device 100 may access a website or a mobile application to retrieve the authorization information. Second, the authorization information may be entered into or scanned into the mobile device 100 from a printer email or receipt. Third, the authorization information may be provided to the mobile device 100 from the lane control console system 32.

The server controller 300 is configured to query the lookup table with the bowler authorization value received from the mobile device 100. In response to the query, the server controller 300 receives the lane identification value from the lookup table in the database 320. The lane identification value indicates a bowling lane authorized to receive control from the mobile device 100.

The communication interface 305 receives a lane control command from the mobile device 100 and sends a response based on the lane control command to the automatic scoring system 110. The response may be further transmitted to the lane control console system 32, the overhead display systems 14, the pinsetter systems 15, the front desk system 16, or the food service system 17.

The display 211 may be combined with the input device 203 as a touch screen, which may capacitive or resistive. In addition, the input device 203 may include one or more buttons, keypad, keyboard, mouse, stylist pen, trackball, rocker switch, touch pad, voice recognition circuit, or other device or component for inputting data to the mobile device 100. The display 211 may be a liquid crystal display (LCD) panel, light emitting diode (LED) screen, thin film transistor screen, or another type of display. The input device 203 may include a camera 209 configured to capture images such as optically machine readable data or QR codes.

Figure 6A:
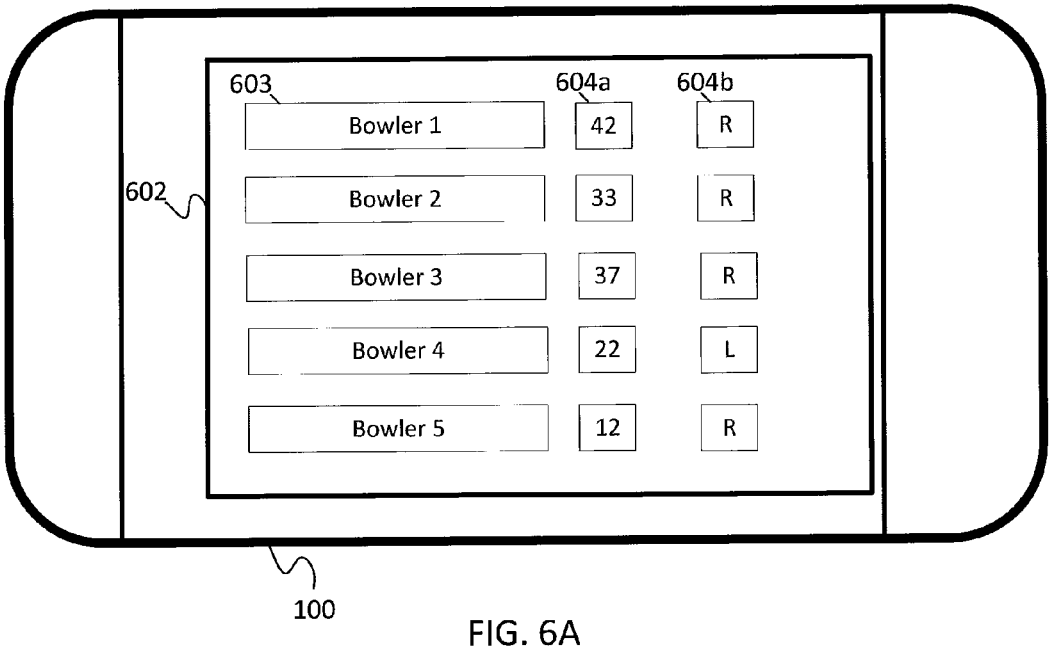
FIGS. 6A and 6B illustrate example displays of the mobile device of FIG. 3.
Figure 6B:
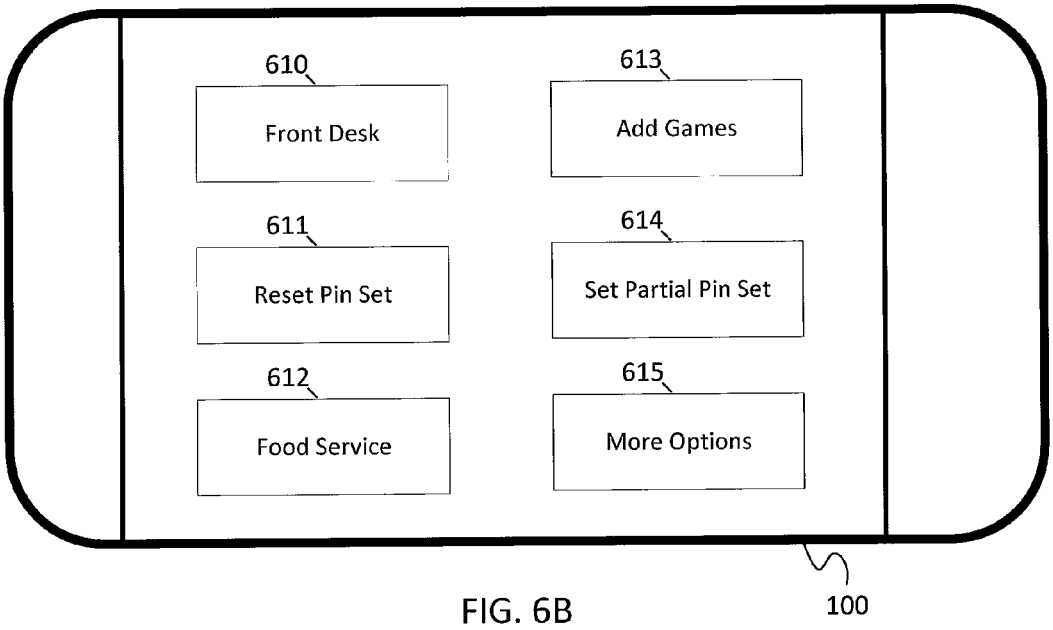

The mobile device 100 is configured to initiate commands that are forwarded by the server 103 to one or more of the lane control console system 32, the overhead display system 14, the pinsetter systems 15, the front desk system 16, and the food service system 17. FIGS. 6A and 6B illustrate example displays or menus for entering commands to the mobile device 100.

The display 602 shown in FIG. 6A includes a list of bowler names 603, and additional bowler characteristics including a list of bowler handicaps 604*a* and a list of bowler handedness indicators 604*b*. The commands sent to the lane control console system 32, which may be referred to as lane operation commands may add bowler names to the list of bowler names 603, enter or change the list of bowler handicaps 604*a*, or enter or change the list of bowler handedness indicators 604*b* between right-handed and left-handed. In addition, the lane operation commands may include a scoring change, a selection of the number of frames to display at once (e.g., 5 or 10) or a selection of bowling display themes (e.g., kid's theme, cartoon theme, league specialized theme, etc.). The lane operation commands may also impact the rules of the game. For example, the lane operation command may toggle a no-tap mode in which nine pins count as a strike, a league mode in which consecutive frames are bowled in adjacent lanes, or a practice skills mode where difficult pin combinations are set up.

Any commands sent to the overhead display system 14 may be referred to as display commands. The overhead display system 14 may be integrated with the lane control console system 32. The display commands may specify a selection of bowling display themes or a selection of the number of frames to display at once, as discussed above. In addition, the display commands may select a television program to be displayed on the overhead display system 14, toggle sending the display of the mobile device 100 to the overhead display system 14, or activate or deactivate a league display.

Any commands sent to the pinsetter systems 15 may be referred to as pinsetter commands. The pinsetter commands may include resetting the full rack when a pin is missing or out of place, setting a partial pint set when a pin has fallen late (the specific pins may be specified by the mobile device 100), a ball return request when a ball has not been returned properly, or an activation or deactivation of gutter bumpers. FIG. 6B illustrates an example menu for the mobile device 100 including pinsetter commands to reset the pin set 611 and to set a partial pin set 614.

Any commands sent to the front desk system 16 may be referred to as front desk commands. The front desk commands may include purchasing additional games, requesting service for the bowling lane, or requesting technical assistance with the console or with the mobile device. FIG. 6B illustrates an example menu for the mobile device 100 including a selection to add games 613 or buzz the front desk 610. For purchases, the server 130 may generate a bowling center purchase code according to communication with the mobile device 100, which is sent to the front desk system 16 after the user makes a purchase through the mobile device 100. In one embodiment, front desk clerks may be omitted. That is, a bowler may enter the bowling center 101, walk down to an empty bowling lane, and purchase bowling without ever interacting with a front desk clerk.

Any commands sent to the food service system 17 may be referred to as food service commands. The food service commands may include ordering a beverage or food item, requesting a server visit the lane, or a request for a menu. The server 130 may be configured to send a menu associated with the bowling center 101 to the mobile device 100 based on the food service command. The server 130 may generate a bowling center purchase code according to the food service command when the mobile device 100 makes a purchase. FIG. 6B illustrates an example menu for the mobile device 100 including a food service option 612. Additional options 615, which include but at not limited to access to premium scoring system features and games, may be provided by the mobile device 100.

The server 130 may be configured to implement an incentive program. The server 130 maintains a user incentive record in database 320 for the incentive program. For each purchase, which includes bowling, food services, reservations, or any other item authorized through the mobile device 100, the user of the mobile device 100 receive a credit in the user incentive record in database 320. The user is credited or awarded discounts, cash, or prizes based on the amount of purchases.

The server 130 may be configured to implement revenue sharing. The server 130 maintains a revenue sharing record in the database 320 across multiple bowling centers. The revenue sharing record reflects purchases, which includes bowling, food services, reservations, or any other item authorized through the mobile device 100. The revenue sharing record is used to attribute revenue to the administrator of the server 130, the administrator of the reservation system, and/or the vendor of a mobile application running on the mobile device 100 facilitating the disclosed embodiments.

The mobile device 100 may be configured to record bowling scores and statistics in the memory 201. The bowling scores are collected at multiple bowling centers. Therefore, the mobile device 100 is configured to calculate bowling average across multiple bowling centers. In addition, the server 130 may collect bowling scores across multiple bowling centers and store statistics in memory 301 or database 320.

The mobile device 100 may be configured to generate a social media posting based on a bowling score. For example, when the mobile device 100 is logged into a social media service (e.g., Facebook, Twitter), the mobile device 100 automatically generates data indicative of a current bowling score and sends the data to the social media service. The mobile device 100 may generate a status message stating that the user is bowling or has checked into a particular bowling center.

Figure 7:
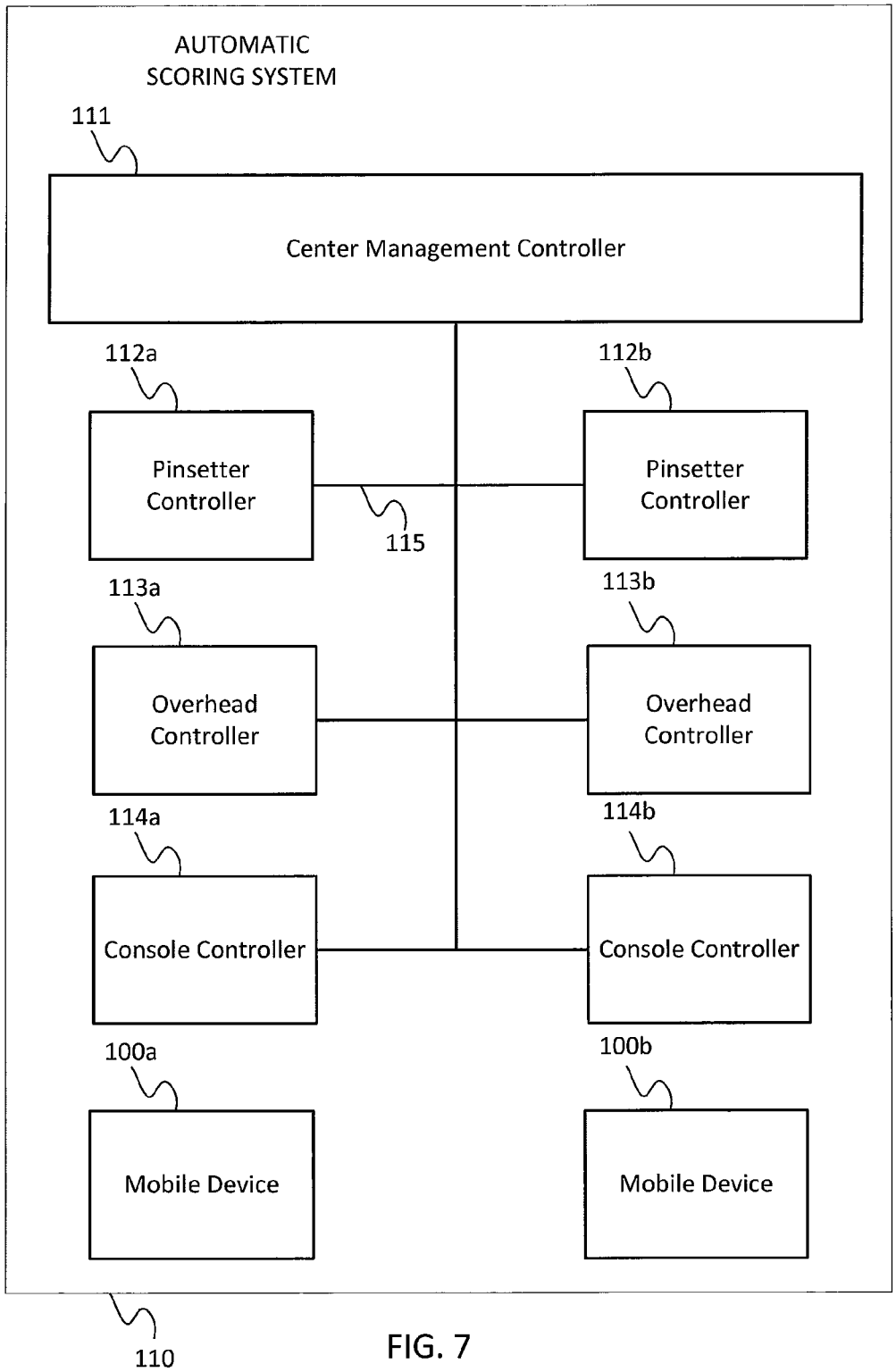
FIG. 7 illustrates an example embodiment of an automatic scoring system of FIG. 2.

FIG. 7 illustrates an example embodiment of the automatic scoring system 110 of FIG. 2. The automatic scoring system 110 includes a center management controller 111 that manages a plurality of bowling lanes. For every N lanes, the automatic scoring system 110 includes a pinsetter controller 112, an overhead controller 113, and a console controller 114. A first mobile device 100*a* may be configured to control a first pinsetter controller 112*a*, a first overhead controller 113*a*, and a first console controller 114*a*. A second mobile device 100*a* may be configured to control a second pinsetter controller 112*a*, a second overhead controller 113*a*, and a second console controller 114*a*. N may be any integer.

The mobile device 100 runs a mobile application that generates bowler authorization information in response to interaction with the reservation system or with the center management controller 111 through the internal network 115. The mobile device 100 is authorized to send commands to a subset of the control systems based on the bowler authorization information, which is associated with a lane identification value that specifies the subset of control systems. The commands may include lane operation commands for the console controller 114, display commands for the overhead controller 113, or pinsetter commands for the pinsetter controller 112.

The commands may be routed through server 130 as discussed above. Alternatively, the mobile device 100 may be in direct communication with the center management controller 111 through the internal network 115 or in direct communication with the any of the control systems through an ad-hoc network (e.g., Bluetooth ad-hoc network). In this implementation the center management controller includes a database including all aspects of the database 320 described herein.

Figure 8:
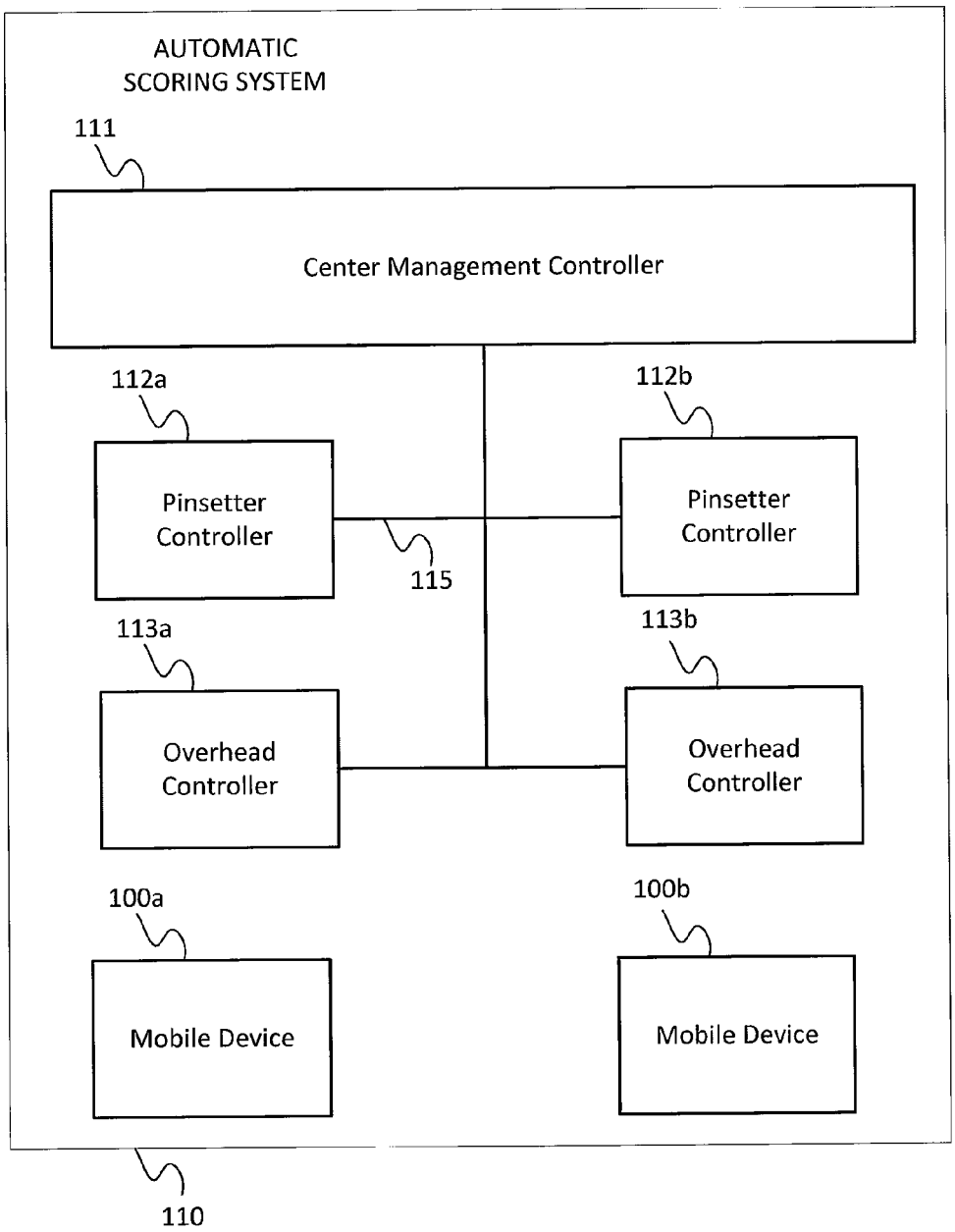
FIG. 8 illustrates another example embodiment of an automatic scoring system of FIG. 2.

FIG. 8 illustrates another example embodiment of the automatic scoring system 110 of FIG. 2. In the embodiment of FIG. 8, the console controller is omitted. The lane control console kiosks may be removed altogether, which provides a substantial cost savings for the bowling center 101. Functions normally associated with the console control system are performed by a combination of the mobile device 100 and the center management controller 111.

Figure 9:
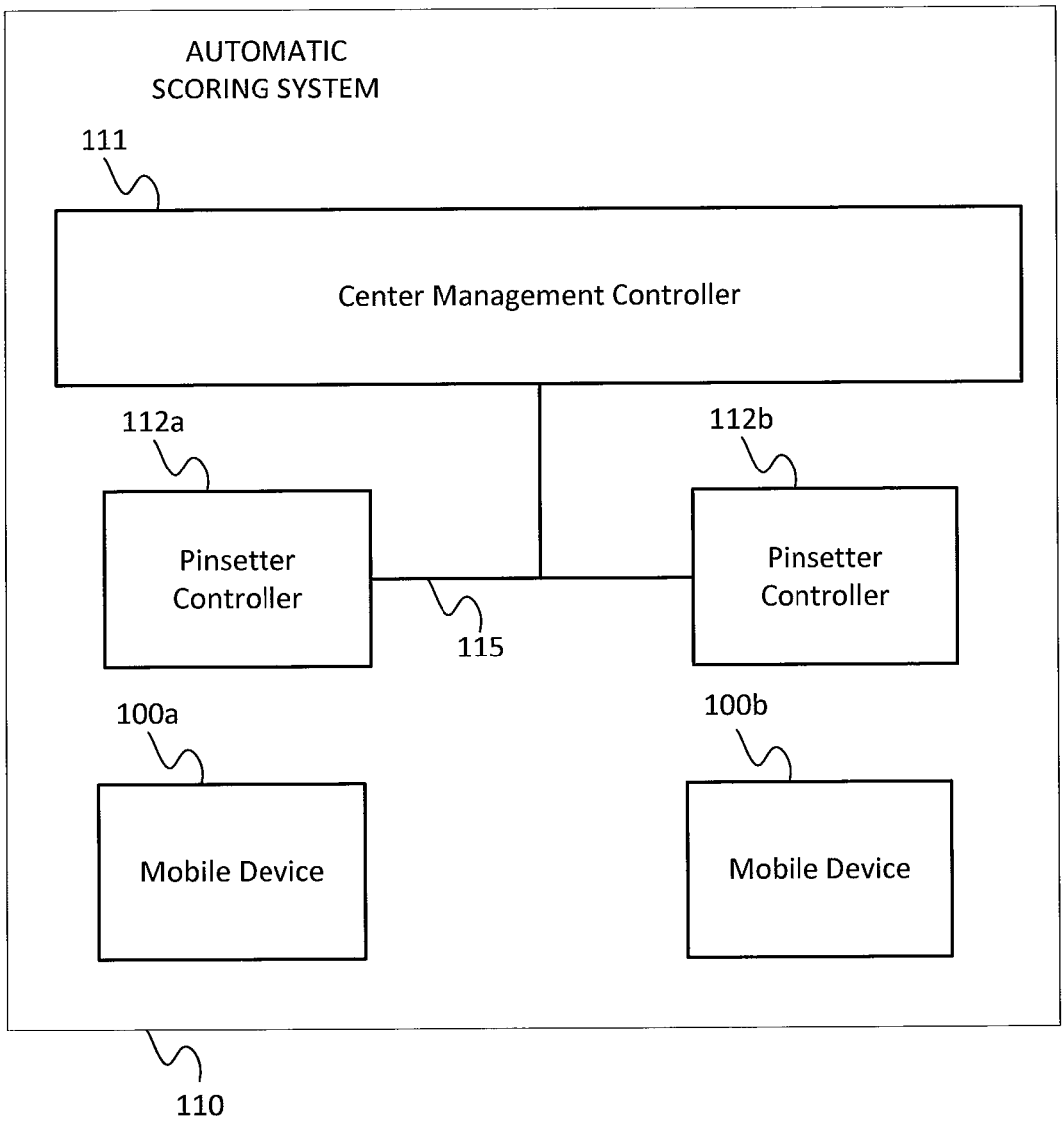
FIG. 9 illustrates another example embodiment of an automatic scoring system of FIG. 2.

FIG. 9 illustrates another example embodiment of the automatic scoring system 110 of FIG. 2. In the embodiment of FIG. 9, the console controller and the overhead controller are omitted. Again, lane control console kiosks may be removed altogether, which provides a substantial cost savings for the bowling center 101. Bowlers may rely exclusively on the mobile device 100 for the function of the console and for the display of the overhead. The mobile device 100 may issue commands directly to the center management controller 111 or through the Internet and/or cellular network to the server 130, which forwards the commands to the center management controller 111. The bowling center 101 may be provided with a pedestal or stand to support the mobile device 100 as a replacement for the console.

Figure 10A:
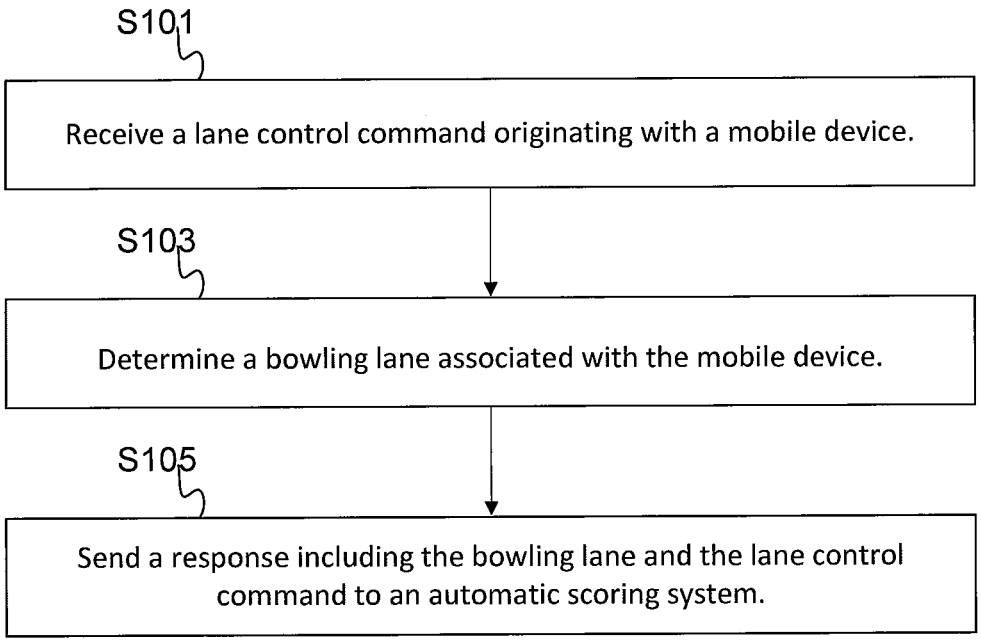
FIGS. 10A and 10B are an example flow chart for the operation of the server of FIG. 2.
Figure 10B:
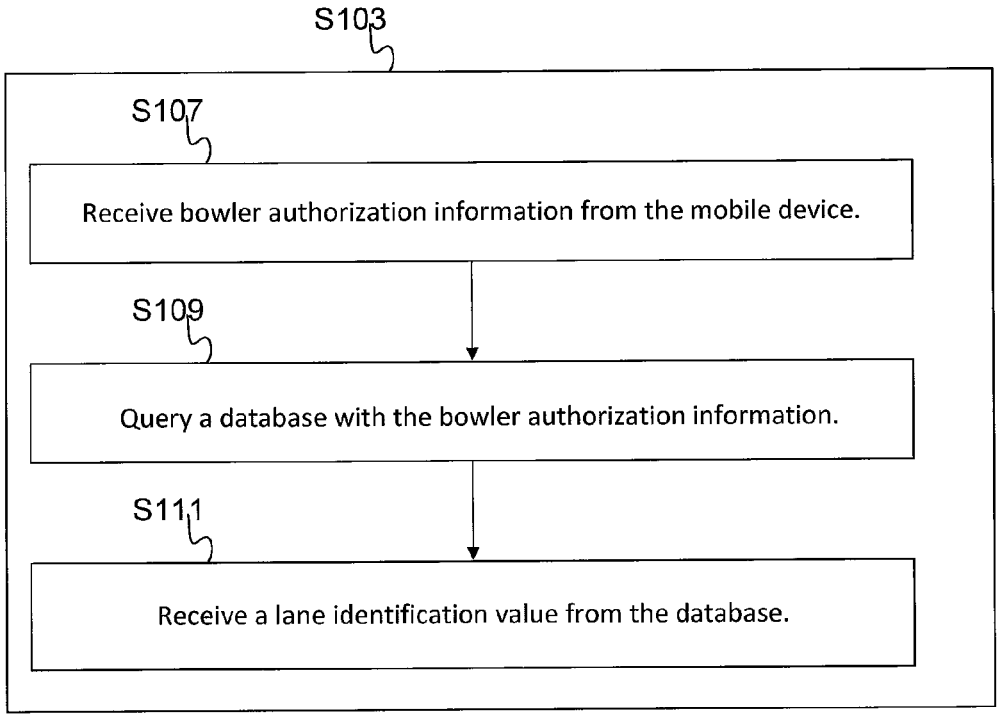

FIGS. 10A and 10B are an example flow chart for the operation of the server 130, when the mobile device 100 communicates with the server 130 through the internet, or the automatic scoring system 110, when the mobile device 100 communicates directly with the bowling center. The term controller refers to the server controller 300 or a controller of the automatic scoring system 110 in the alternative.

At S101, the controller receives a lane control command that originated with the mobile device. The lane control command may be include any combination of a pinsetter reset, a scoring change, a lineup change, a player identification, a player characteristic, a display preference, a partial rack placement of pins, a help request, or a food service request. Alternatively, the lane control command may include only a request to control the lane. The lane control command may be generated when the mobile application has been launched but before the user has actually made any lane control selections.

At S103, the controller determined which, if any, bowling lanes are associated with the mobile device 100. The mobile device 100 may be deemed associated with a particular bowling lane if the lane control command requests to be associated with the particular bowling lane. However, a more secure algorithm may be used to associate the mobile device 100 with the particular bowling lane, which is discussed in more detail below.

At S105, the controller sends a response to the automatic scoring system 110. The response includes data indicative of the bowling lane and the lane control system. The automatic scoring system 110 follows the lane control command as requested by the mobile device 100.

FIG. 10B illustrates a secure algorithm for determining which bowling lane is associated with the mobile device 100, which is an expansion of S103.

At S107, the controller receives bowler authorization information from the mobile device 100. The bowler authorization information may be created from a successful login to a reservation system. The bowler authorization information may be created from a scan by the mobile 100 device of an authorization code. The bowler authorization information may be created from a manual entry of an identification code or reservation confirmation code into the mobile device 100.

At S109, the controller queries a database with the bowler authorization information. The database includes a look up table that associates the bowler authorization information with one or more lanes at the bowling center 101. The database includes entries pairing bowler authorization information with lane identification values.

At S111, the controller receives the lane identification value from the database. The lane identification values instruct the controller that the mobile device 100 is authorized to issue commands to control the one or more lanes. In addition, the lane identification values may authorize the mobile device 100 to issue commands for other services such as purchasing bowling or food service. The lane identification value may expire. In addition to specifying the bowling center and the one or more lanes, the lane identification value may include a duration value. The duration value may bet set according to a number of games (e.g., 1, 2, or 10 games, etc.) or an amount of time (e.g., 30 minutes, 1 hour, etc.). In one format, the lane identification value may include {bowling center ID}:{lane ID}:{number of games}. When the duration expires, the mobile device 100 is no longer authorized to issue commands.

The controller may also be configured to send advertisements to the mobile device 100. The advertisements may be related to additional games of bowling or seasonal specials at the bowling center. In addition, the controller may be configured to analyze the bowling games associated with the mobile device 100. For example, novice bowlers may be presented with advertising for lessons or equipment. Further, bowlers may be presented with hints or tips based on the bowling games. For example, if the bowler consistently missed the pocket by the same amount, the controller may suggest a correction.

Figure 11:
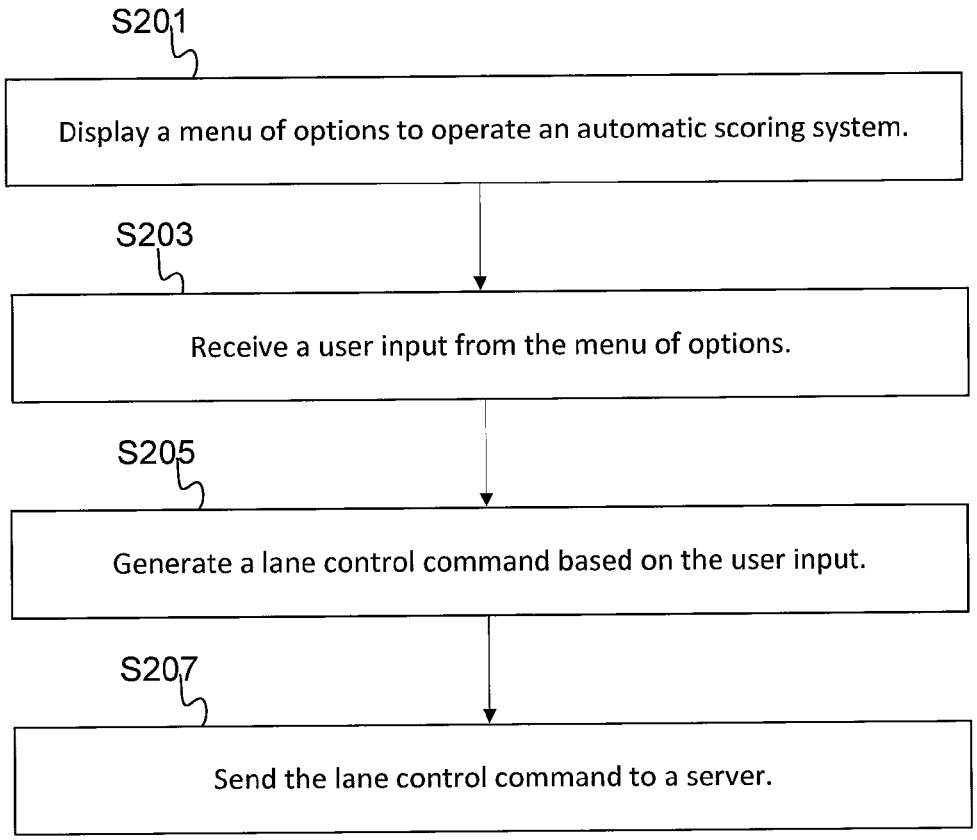
FIG. 11 is an example flow chart for the operation of the mobile device of FIG. 2.

FIG. 11 is an example flow chart for the operation of the mobile device 100. At S201, the display 211 displays a menu of options available to a user to operate the automatic scoring system. The menu of options may include but is not limited to a front desk help request, add bowlers, change score, add games, reset pins, and a food service request. At S203, the input device 203 receives a user input from the menu of options. The input device 203 may be a touchscreen.

At S205, the controller generates a lane control command according to the user input. The lane control command is sent either directly to the automatic scoring system 110 or indirectly through the server 130. The lane control command allows the mobile device 100 to control any of the control systems discussed above.

The lane control command may include bowling authorization information. The bowling authorization information may be a manually entered code. The manually entered code may be received from a reservation system in an email or received from a front desk. The bowling authorization information may be a QR code printed from an email or a receipt and scanned by the camera 209 of the mobile device 100. The bowling authorization information may be assumed based on the connectivity of the mobile device (e.g., when the mobile device 100 is connected to the bowling center internal network or when the mobile device 100 is connected to the console system 32, or the automatic scoring system 110 via an ad-hoc network).

At S207, the communication interface 205 sends the lane control command to the server 130. As discussed above, the server 130 determines whether the mobile device 100 is associated with any bowling lanes. For example, the server 130 may respond to the mobile device 100 with a lane identification value. The lane identification value specifies which lane or lanes in the bowling center 101 that the mobile device 100 can control and serves as a confirmation to the mobile device 100 that the mobile device 100 is authorized to initiate commands. The mobile device 100 may display a confirmation message such as "connected to lane 1." The lane identification value may originate in the bowling authorization information or the lane identification value may be paired with the bowling authorization information in the database 320.

The database 320 may also include a look up table that associates the bowler authorization information with one or more other lanes or mobile devices belong to a group or a league. The database authorizes communication between the mobile devices in the group or league. The mobile device 100 may be configured to generate a message that appears at the mobile devices or console systems of other bowlers in the group or league. The messages may be routed through the server 130 and the automatic scoring system 110.

The present embodiments may be applied to systems not related to bowling using the same principles. For example, the present embodiments may be applied to any purchase-per-use activity such as billiards, darts, air hockey, shuffleboard, or batting cages. In each example, the mobile device 100 is authorized to communicate with the server 320, which issues commands to a controller associated with any of the purchase-per-use activities. The present embodiment may also be applied to other activities besides purchase-per-use activities such as any activities with an electronic scoring system or an electronic scoreboard. Activities with an electronic scoring system or an electronic scoreboard may include basketball, baseball, hockey, football, and others. The mobile device 100 may be configured to adjust or control the electronic scoring system or the electronic scoreboard and configured to accumulate and store statistics.

The memory 211 and/or memory 301 may store computer executable instructions for filtering and routing communication session requests. The server controller 300 may execute computer executable instructions stored in the memory 301. The mobile device controller 200 may execute computer executable instructions stored in the memory 211. The computer executable instructions may be included in computer code. The computer code may be written in any computer language, such as C, C++, C#, Java, Pascal, Visual Basic, Perl, Hypertext Markup Language (HTML), JavaScript, assembly language, extensible markup language (XML) and any combination thereof.

The computer code may be stored in one or more tangible media or one or more non-transitory computer readable media for execution by the mobile device controller 200 or the server controller 300. A computer readable medium may include, but is not limited to, a floppy disk, a hard disk, an application specific integrated circuit (ASIC), a compact disk CD, other optical medium, a random access memory (RAM), a read only memory (ROM), a memory chip or card, a memory stick, and other media from which a computer, a processor or other electronic device can read.

The mobile device controller 200 and/or the server controller 300 may include a general processor, digital signal processor, application specific integrated circuit, field programmable gate array, analog circuit, digital circuit, server processor, combinations thereof, or other now known or later developed processor. The mobile device controller 200 or the server controller 300 may be a single device or combinations of devices, such as associated with a network or distributed processing. Any of various processing strategies may be used, such as multi-processing, multi-tasking, parallel processing, remote processing, centralized processing or the like. The mobile device controller 200 or the server controller 300 may be responsive to or operable to execute instructions stored as part of software, hardware, integrated circuits, firmware, micro-code or the like.

The communication interfaces 205 and 305 may include any operable connection. An operable connection may be one in which signals, physical communications, and/or logical communications may be sent and/or received. An operable connection may include a physical interface, an electrical interface, and/or a data interface. An operable connection may include differing combinations of interfaces and/or connections sufficient to allow operable control. For example, two entities can be operably connected to communicate signals to each other or through one or more intermediate entities (e.g., processor, operating system, logic, software). Logical and/or physical communication channels may be used to create an operable connection. As used herein, the phrases "in communication" and "coupled" are defined to mean directly connected to or indirectly connected through one or more intermediate components. Such intermediate components may include both hardware and software based components.

The memory 211 and/or memory 301 may be any known type of volatile memory or a non-volatile memory. The memory 211 and/or memory 301 may include one or more of a read only memory (ROM), dynamic random access memory (DRAM), a static random access memory (SRAM), a programmable random access memory (PROM), a flash memory, an electronic erasable program read only memory (EEPROM), static random access memory (RAM), or other type of memory. The memory 211 and/or memory 301 may include an optical, magnetic (hard drive) or any other form of data storage device. The memory 211 may be located in a remote device or removable, such as a secure digital (SD) memory card.

Various embodiments described herein can be used alone or in combination with one another. The foregoing detailed description has described only a few of the many possible implementations of the present embodiments. For this reason, this detailed description is intended by way of illustration, and not by way of limitation.

We claim:

1. A method comprising:

performing the following in a network device having a communication interface configured to communicate with a mobile device associated with one of a plurality of bowling lanes on which a bowling game is played:

receiving a bowling game scoring command originating from the mobile device, the bowling game scoring command being received to command an automatic scoring system to enter bowling game scoring information to score the bowling game played on the bowling lane that is associated with the mobile device;

determining which one of the plurality of bowling lanes is associated with the mobile device; and sending a response including data indicative of the bowling lane that is associated with the mobile device and the bowling game scoring command originating from the mobile device to the automatic scoring system to score the bowling game played on the bowling lane that is associated with the mobile device, wherein the automatic scoring system enters the bowling game scoring information to score the bowling game played on the bowling lane that is associated with the mobile device and not on the other bowling lanes, wherein determining which one of the plurality bowling lanes is associated with the mobile device comprises:
receiving bowler authorization information;
querying a database with the bowler authorization information,
wherein the database associates the bowler authorization information with a lane identification value; and
receiving the lane identification value based on querying the database.

2. The method of claim 1, wherein the bowler authorization information is accessed from a reservation system.

3. The method of claim 1, wherein the bowler authorization information is accessed from an optically machine readable code.

4. The method of claim 1, wherein the bowler authorization information is accessed from a receipt.

5. The method of claim 1, further comprising:
generating a bowling center purchase code according to communication with the mobile device.

6. The method of claim 1, wherein the bowling game scoring information includes data indicative of one or more of a scoring change, a lineup change, a player identification, or a player characteristic.

7. The method of claim 1, wherein the automatic scoring system is configured to initiate display of game information according to the bowling game scoring command.

8. The method of claim 1, wherein the automatic scoring system is configured to reset bowling pins.

9. A network device comprising:
a communication interface configured to receive a bowling game scoring command originating with a mobile device that is associated with one of a plurality of bowling lanes on which a bowling game is played, the bowling game scoring command received to command an automatic scoring system to enter bowling game scoring information to score the bowling game played on the one of the plurality of bowling lanes associated with the mobile device;
a memory configured to store a lookup table that associates bowler authorization values with lane identification values; and
a controller configured to:
determine which one of the plurality of bowling lanes is associated with the mobile device and send a response including data indicative of the bowling lane that is associated with the mobile device and the bowling game scoring command originating from the mobile device to the automatic scoring system to score the bowling game that is associated with the mobile device, wherein the automatic scoring system enters the bowling game scoring information to score the bowling game played on the bowling lane that is associated with the mobile device and not on the other bowling lanes,
wherein the controller, to determine which one of the plurality of bowling lanes is associated with the mobile device, is configured to:
query the lookup table with a bowler authorization value received from the mobile device; and
receive a lane identification value in response to the query.

10. The network device of claim 9, wherein the bowler authorization value is stored in a quick response code scanned by the mobile device.

11. The network device of claim 9, wherein the bowler authorization value is sent to the mobile device with a purchase receipt or an email confirmation.

12. The network device of claim 9, wherein the bowler authorization value is scanned from an optically readable code physically located at the bowling lane associated with the lane identification value.

13. The network device of claim 9, wherein the response includes data to configure display of game information in the automatic scoring system.

14. The network device of claim 9, wherein the controller is further configured to send a pinsetter response that includes data to reset bowling pins according to a received pinsetter command.

15. The network device of claim 9, wherein the bowling game scoring information includes data indicative of one or more of a scoring change, a lineup change, a player identification, or a player characteristic.

16. The network device of claim 9, further comprising:
a database configured to log the authorized communication from the mobile device in a revenue sharing account across multiple bowling centers.

17. A non-transitory computer readable medium containing instructions configured to cause a processor to:
display, on a mobile device, a menu of options to operate an automatic scoring system;
receive a user input from the menu of options;
generate a bowling game scoring command based on the user input, the bowling game scoring command generated to command the automatic scoring system to enter bowling game scoring information to score a bowling game played on one of a plurality of bowling lanes associated with the mobile device;
send the bowling game scoring command to a server, wherein the server determines which one of the plurality of bowling lanes is associated with the mobile device by receiving bowling authorization information, querying a database with the bowler authorization, wherein the database associates the bowler authorization information with a lane identification value, and receiving the lane identification value based on querying the database, and wherein the server sends a response including data indicative of the bowling lane that is associated with the mobile device and the bowling game scoring command originating from the mobile device to the automatic scoring system to score the bowling game played on the bowling lane that is associated with the mobile device, wherein the automatic scoring system enters the bowling game scoring information to score the bowling game played on the bowling lane that is associated with the mobile device and not on the other bowling lanes.

18. The non-transitory computer readable medium of claim 17, wherein the instructions are configured to further cause the processor to:
capture an image of an optically machine readable code; and
generate the bowling authorization information from the optically machine readable code.

19. The method of claim 1, wherein the communication interface is configured to communicate with a plurality of mobile devices, each mobile device being associated with a different bowling lane among the plurality of bowling lanes on which a plurality of bowling games are played, the method further comprising:
sending, with the network device, a plurality of responses to the automatic scoring system to score the plurality bowling games, each response including data indicative of a respective different bowling lane and a respective bowling game scoring command originating with an associated one of the plurality of mobile devices.

20. The network device of claim 9, wherein the communication interface is configured to communicate with a plurality of mobile devices, each mobile device being associated with a different bowling lane among the plurality of bowling lanes on which a plurality of bowling games are played, and wherein the controller is configured to send a plurality of responses to the automatic scoring system to score the plurality of bowling games, each response including data indicative of a respective different bowling lane and a respective bowling game scoring command originating with an associated one of the plurality of mobile devices.

* * * * *